US009791155B2

(12) United States Patent
Blouin

(10) Patent No.: US 9,791,155 B2
(45) Date of Patent: Oct. 17, 2017

(54) SOLID FUEL BURNING STOVE AND DOOR LOCKING ASSEMBLY FOR A SOLID FUEL BURNING STOVE

(71) Applicant: FABRICANT DE POÊLES INTERNATIONAL INC., St-Augustin-de Desmaures (CA)

(72) Inventor: Éric Blouin, Québec (CA)

(73) Assignee: FABRICANT DE POÊLES INTERNATIONAL INC., Saint-Augustin-de Desmaures (CA)

( * ) Notice: Subject to any disclaimer, the term of this patent is extended or adjusted under 35 U.S.C. 154(b) by 470 days.

(21) Appl. No.: 14/602,802

(22) Filed: Jan. 22, 2015

(65) Prior Publication Data

US 2016/0215985 A1 Jul. 28, 2016

(30) Foreign Application Priority Data

Jan. 19, 2015 (CA) ..... 2878537

(51) Int. Cl.

| | |
|---|---|
| ***F24B 13/00*** | (2006.01) |
| ***F24C 15/02*** | (2006.01) |
| ***F24B 1/02*** | (2006.01) |

(52) U.S. Cl.

CPC ..... *F24B 13/004* (2013.01); *F24B 1/02* (2013.01); *F24C 15/02* (2013.01); *F24C 15/022* (2013.01); *F24C 15/024* (2013.01)

(58) Field of Classification Search

CPC ..... F24B 1/02; F24B 13/004; F24C 15/02; F24C 15/022; F24C 15/023; F24C 15/024; F24C 15/028; E05Y 2900/308; F23M 7/00

See application file for complete search history.

(56) References Cited

U.S. PATENT DOCUMENTS

| | | | | |
|---|---|---|---|---|
| 4,088,354 | A * | 5/1978 | Kolendowicz | E05B 47/0603 292/201 |
| 4,437,451 | A * | 3/1984 | Wysong | F23G 7/07 110/203 |
| 4,469,083 | A * | 9/1984 | Helle | F24B 1/02 126/200 |
| 5,005,555 | A * | 4/1991 | Vogelzang | F24B 1/10 126/289 |

(Continued)

*Primary Examiner* — David J Laux

(74) *Attorney, Agent, or Firm* — Marshall, Gerstein & Borun LLP

(57) ABSTRACT

There is provided a solid fuel burning stove comprising a housing defining a combustion chamber and a door panel pivotally mounted to the housing. The door panel is configurable between an open configuration and a closed configuration. The solid fuel burning stove is characterized by having a locking assembly comprising a lever pivotally mounted to the housing and having a hooked portion. The lever is pivotable between an engaged configuration and a disengaged configuration. The locking assembly also has a biasing member operatively connected to the housing and the lever and biasing the lever in the engaged configuration. The locking assembly further comprises a catch provided on the door panel. The hooked portion of the lever is engageable with the catch in the closed configuration of the door panel and the engaged configuration of the lever and is disengageable therefrom by configuring the lever in the disengaged configuration.

16 Claims, 7 Drawing Sheets

(56) References Cited

U.S. PATENT DOCUMENTS

| | | | | |
|---|---|---|---|---|
| 7,048,312 | B2 * | 5/2006 | Brunner | E05B 63/246 292/137 |
| 7,091,458 | B2 * | 8/2006 | Lee | F24C 15/022 219/414 |
| 7,942,027 | B1 * | 5/2011 | Cassini | E05B 13/004 292/100 |
| 8,640,655 | B2 * | 2/2014 | Furman | F23B 50/06 110/158 |
| 8,646,816 | B2 * | 2/2014 | Dziurdzia | E05B 17/0029 292/201 |
| 9,279,589 | B2 * | 3/2016 | Lau | E05B 3/00 |
| 2001/0037803 | A1 * | 11/2001 | Perrault | F24B 1/02 126/60 |
| 2011/0168153 | A1 * | 7/2011 | Purinton | F24B 1/187 126/77 |
| 2011/0289853 | A1 | 12/2011 | Lau et al. | |

* cited by examiner

SOLID FUEL BURNING STOVE AND DOOR LOCKING ASSEMBLY FOR A SOLID FUEL BURNING STOVE

TECHNICAL FIELD OF THE INVENTION

The technical field relates to solid fuel burning stoves having a pivotally mounted door with a door locking assembly. The invention also relates to a door locking assembly for a solid fuel burning stove.

BACKGROUND

Heating systems, and more specifically fireplaces, wood stoves and the like have been designed to burn fuel efficiently and provide great heat output. Known systems have employed door panels to allow access to the combustion chamber while providing a safe combustion environment. A door panel maintained in closed configuration can prevent combustion gases to escape from the combustion chamber elsewhere than the combustion gas outlet port and prevent the burning fuel to fall out from the combustion chamber.

Known door panels are equipped with one or more handles that allow for the doors to be operated in order to add fuel, clean the stove, or otherwise access the combustion chamber. Known handles are generally large and located on a front face of the door panel. Such configuration can be undesirable in a given decor.

The stove can also be equipped with a locking assembly allowing the door panel to be maintained in a closed configuration in order, for instance, to limit heat losses through a gap formed between the stove housing and the door panel and to ensure that the door panel remains in the closed configuration.

Generally, the locking assembly and the door handle are made of materials that are resistant to thermal stress, but typically conduct thermal loads. As such, the door handle and the locking assembly can become very hot and there is an increased risk of a user being burned while operating the door and the locking system. Moreover, some known locking assemblies require the operator to configure the door in a closed configuration and then, in a subsequent operation, to lock the door in place in order to maintain the door of the stove in a closed configuration.

In addition, some known locking assemblies are mounted on the stove door panel along with the door handle. This configuration of components can be aesthetically unpleasing in some decors. Contemporary designs asks for a more streamlined locking assembly and handle combination having, for example, the door handle not mounted on a front face of the door panel.

As such, there is a need for a streamlined and esthetically pleasing door handle that would be easily accessible while most of the locking assembly parts would be hidden. At the same time, those components need to remain at a comfortable temperature for the operator who operates the door and the locking assembly.

In view of the above, there is a need for a door locking assembly for a solid fuel burning stove which would be able to overcome or at least minimize some of the above-discussed prior art concerns.

BRIEF SUMMARY OF THE INVENTION

In accordance with a first aspect, there is provided a solid fuel burning stove comprising a housing defining a combustion chamber and a door panel pivotally mounted to the housing. The door panel is configurable between an open configuration allowing access to the combustion chamber and a closed configuration preventing access to the combustion chamber. The solid fuel burning stove also has a locking assembly comprising a lever pivotally mounted to the housing and having a hooked portion. The lever is pivotable between an engaged configuration and a disengaged configuration. The locking assembly also comprises a biasing member operatively connected to the housing and the lever and biasing the lever in the engaged configuration. The locking assembly further comprises a catch provided on the door panel. The hooked portion of the lever is engageable with the catch in the closed configuration of the door panel and the engaged configuration of the lever and is disengageable therefrom by configuring the lever in the disengaged configuration.

In an embodiment, the lever comprises a lever handle extending outwardly from the housing.

In an embodiment, the housing comprises a side wall partially defining the combustion chamber and a corner panel extending adjacent to the side wall and including a lever handle aperture and a catch aperture. A section of the lever extends between the side wall and the corner panel with the lever handle extending through the lever handle aperture and the catch being inserted in the catch aperture in the closed configuration of the door panel.

In an embodiment, at least one of the catch and the hooked portion of the lever is located behind a front face of the door panel in the closed configuration thereof.

In an embodiment, the hooked portion of the lever comprises a beveled and rearwardly extending surface and a notch. The notch extends rearwardly of the beveled and rearwardly extending surface. The beveled and rearwardly extending surface biases the catch towards the notch of the hooked portion of the lever when configuring the door panel from the open configuration to the closed configuration.

In an embodiment, the locking assembly comprises a toe protruding outwardly from the housing and positioned to stop the pivoting of the lever in at least one of the engaged configuration and the disengaged configuration.

In an embodiment, the lever comprises a guide track channel and the toe extends within the guide track channel of the lever.

In an embodiment, the lever pivots between the engaged configuration and the disengaged configuration about a pivot axis located between the hooked portion of the lever and the guide track channel.

In an embodiment, the biasing member has a distal end operatively connected to the housing and a proximal end operatively connected to the lever rearwardly from the hooked portion of the lever and the pivot axis.

In an embodiment, the catch comprises a resilient sleeve, the hooked portion of the lever being engaged therewith in the closed configuration of the door panel and the engaged configuration of the lever.

In an embodiment, the door panel comprises a door handle extending outwardly therefrom.

In an embodiment, at least one of the door panel and the housing comprises a seal member surrounding an aperture of the combustion chamber. The seal member is resiliently compressed between the housing and the door panel in the closed configuration and the engaged configuration of the lever.

In an embodiment, the door panel pivots from the closed configuration to the open configuration upon configuration of the lever from the engaged configuration to the disengaged configuration by expansion of the seal member.

In accordance with another aspect, there is provided a solid fuel burning stove comprising a housing comprising a plurality of walls partially defining a combustion chamber, a lever pivotally mounted to at least one of the walls, a biasing member having a proximal end operatively connected to the lever and a distal end mounted to at least one of the walls. The lever comprises a hooked portion and is pivotable about a pivot axis between an engaged configuration and a disengaged configuration. The biasing member biases the lever towards the engaged configuration. The solid fuel burning stove further comprises a door panel pivotally mounted to the housing and configurable between an open configuration and a closed configuration. The door panel comprises a catch, the hooked portion of the lever being engageable with the catch of the door panel in the closed configuration thereof and in the engaged configuration of the lever and being disengageable therefrom by configuring the lever in the disengaged configuration.

In an embodiment, the lever and the biasing member are mounted to a side wall.

In an embodiment, the lever comprises a lever handle extending outwardly from the housing.

In an embodiment, the housing comprises a corner panel mounted adjacent to the side wall and includes a lever handle aperture and a catch aperture. A section of the lever extends between the side wall and the corner panel with the lever handle extending through the lever handle aperture and the catch being inserted in the catch aperture in the closed configuration of the door panel.

In an embodiment, at least one of the catch and the lever is located behind a front face of the door panel in the closed configuration thereof.

In an embodiment, the hooked portion of the lever comprises a beveled and rearwardly extending surface and a notch. The notch extends rearwardly of the beveled and rearwardly extending surface. The beveled and rearwardly extending surface biases the catch towards the notch of the hooked portion of the lever when configuring the door panel from the open configuration to the closed configuration.

In an embodiment, the housing comprises a toe protruding outwardly from the housing and positioned to stop the pivoting of the lever in at least one of the engaged configuration and the disengaged configuration.

In an embodiment, the lever comprises a guide track channel and the toe extends within the guide track channel of the lever.

In an embodiment, the pivot axis is located between the hooked portion of the lever and the guide track channel.

In an embodiment, the proximal end of the biasing member is operatively connected to the lever rearwardly from the hooked portion of the lever and the pivot axis.

In an embodiment, the catch of the door panel comprises a resilient sleeve, the hooked portion of the lever being engaged therewith in the closed configuration of the door panel and the engaged configuration of the lever.

In an embodiment, the door panel comprises a door handle extending outwardly therefrom.

In an embodiment, at least one of the door panel and the housing comprises a seal member surrounding an aperture of the combustion chamber. The seal member is resiliently compressed between the housing and the door panel in the closed configuration and the engaged configuration of the lever.

In an embodiment, the door panel pivots from the closed configuration to the open configuration upon configuration of the lever from the engaged configuration to the disengaged configuration by expansion of the seal member.

BRIEF DESCRIPTION OF THE DRAWINGS

It will be noted that throughout the appended drawings, like features are identified by like reference numerals.

DETAILED DESCRIPTION

In the following description, the same numerical references refer to similar elements. Furthermore, for the sake of simplicity and clarity, namely so as to not unduly burden the figures with several references numbers, not all figures contain references to all the components and features, and references to some components and features may be found in only one figure, and components and features of the present disclosure which are illustrated in other figures can be easily inferred therefrom.

Although the embodiments of a solid fuel burning stove door and a door locking system for the solid fuel burning stove and corresponding parts thereof consist of certain geometrical configurations as explained and illustrated herein, not all of these components and geometries are essential and thus should not be taken in their restrictive sense. It is to be understood, as also apparent to a person skilled in the art, that other suitable components and cooperation thereinbetween, as well as other suitable geometrical configurations, may be used for the solid fuel burning stove door and the door locking system for the solid fuel burning stove, as will be briefly explained herein and as can be easily inferred herefrom by a person skilled in the art. Moreover, it will be appreciated that positional descriptions such as "above", "below", "left", "right", "top", "bottom", "at the back of", "in front of" and the like should, unless otherwise indicated, be taken in the context of the figures and should not be considered limiting.

Figure 1:
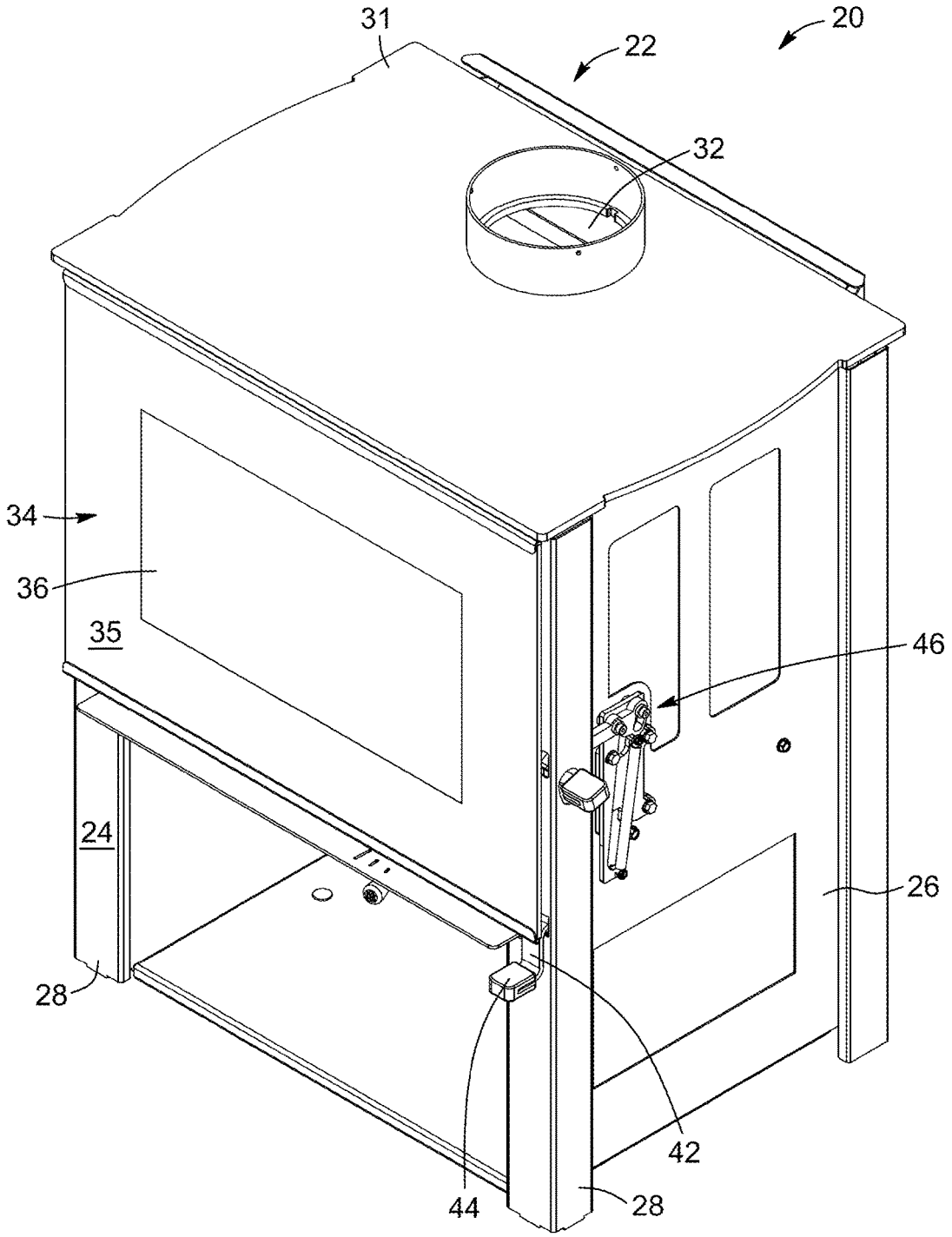
FIG. 1 is a perspective view of a solid fuel burning stove in accordance with an embodiment wherein a door panel is in a closed configuration.
Figure 2:
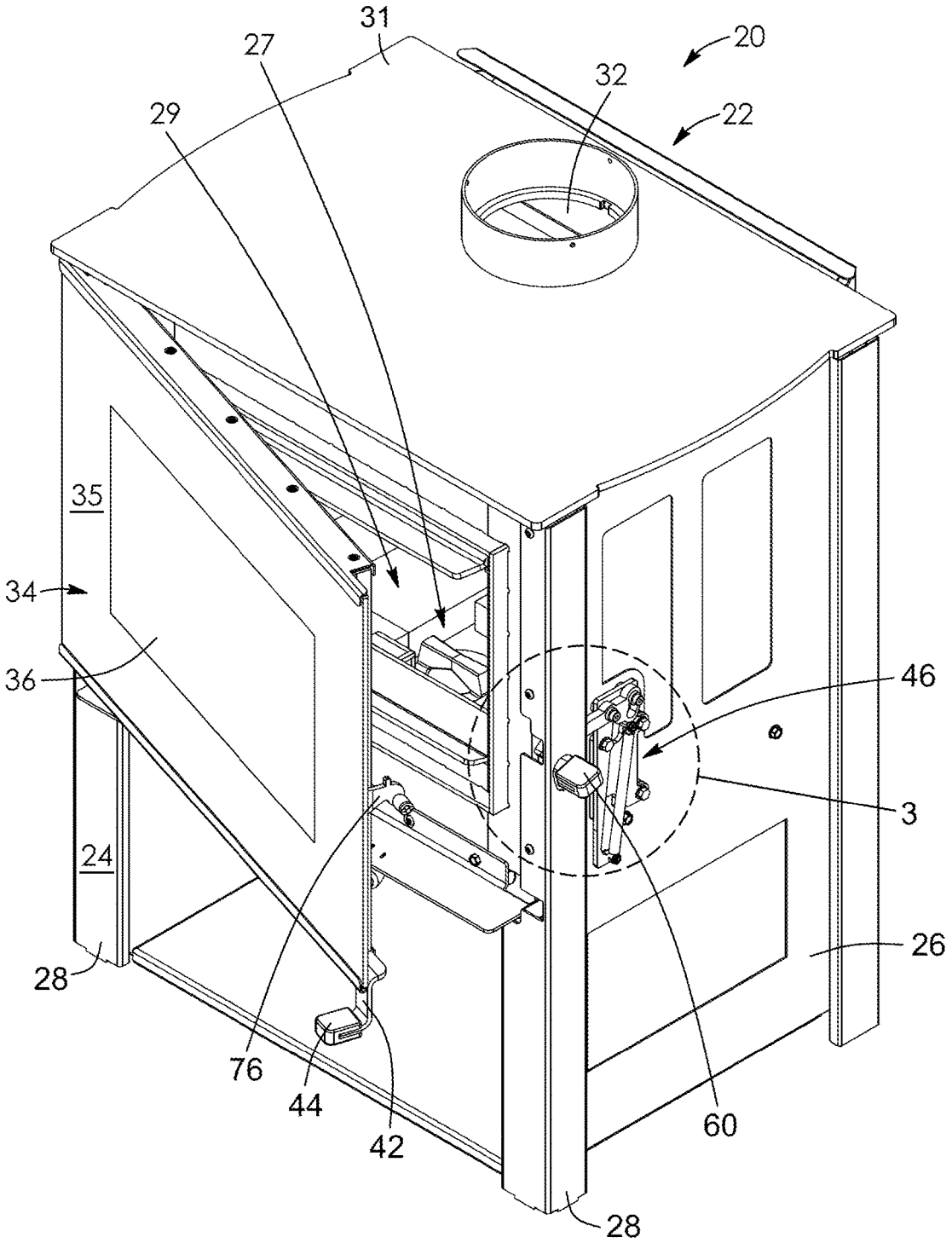
FIG. 2 is a perspective view of the solid fuel burning stove shown in FIG. 1 wherein the door panel is in an open configuration.

Referring now to the drawings and, more particularly, referring to FIGS. 1 and 2, there is shown one embodiment of a solid fuel burning stove 20. The solid fuel burning stove 20 can be conceived for burning solid fuel such as wood, coal, charcoal briquettes, ecological logs, wood pellets or the like. It is to be understood, as also apparent to a person skilled in the art, that other suitable solid fuel can be burned in such solid fuel burning stove 20. In some implementations, the solid fuel burning stove 20 can be provided as standalone furniture or built into a wall or a column of a building.

The solid fuel burning stove 20 includes a housing 22 having a plurality of walls defining the faces of the stove 20. The walls also partially define a combustion chamber 27 inside those walls where combustion of the solid fuel is to occur. As used herein, "inside" and "interior" each interchangeably refer to the space or environment which is enclosed by a housing of the solid fuel burning stove. Similarly, "outside" and "exterior" are used interchangeably herein to refer to the space or environment which surrounds outwardly the housing of the solid fuel burning stove.

The front face 24 is typically the one providing access to the combustion chamber 27. The other walls of the housing 22, located on the right, on the left and at the back of the housing 22 are respectively side walls 26 and rear wall (not shown) and they also partially define the combustion chamber 27. The housing 22 also includes a top wall 31. Combustion gases generated by the burning of the fuel can be evacuated from the combustion chamber 27 by an outlet port 32 located on the top wall 31 of the housing 22, as shown in FIGS. 1 and 2. It is appreciated that the shape of the housing 22 including the location and configuration of the outlet port 32 can vary from the embodiment shown.

The solid fuel burning stove 20 also includes a door panel 34 pivotally mounted to the housing 22 and being configurable between an open configuration allowing access to the combustion chamber 27 and a closed configuration preventing access to the combustion chamber 27. For example, the closed configuration corresponds to the door panel 34 being pivoted substantially in the same plane as the front face 24 of the housing 22 and therefore preventing access to the combustion chamber 27. Accordingly, when the door panel 34 is in the closed configuration, as shown in FIG. 1, the door panel 34 has a front face 35 facing the exterior of the solid fuel burning stove 20. In the open configuration, the door panel 34 defines a non-void angle with the front face 24 of the housing 22.

The front face 35 of the door panel 34 can be designed and shaped in a variety of ways in order to be aesthetically pleasing. For instance, in the embodiment shown in FIG. 1, the door panel 34 can include a combustion chamber window 36. The combustion chamber window 36 can allow, for example, visual access to the combustion chamber 27 so that a person can thus visually witness the combustion occurring during the burning operation in the solid fuel burning stove 20, either to appreciate the appealing visual effect of flames, or to monitor the intensity and/or efficiency of the combustion occurring inside the combustion chamber 27. The combustion chamber window 36 can be made of, for example, a tempered or other suitable glass panel.

In the embodiment shown, the housing 22 further includes corner panels 28 extending adjacent to a junction of the front face 24 and a respective one of the side walls 26 of the housing 22, at each corner thereof. The corner panels 28 can be shaped and designed to be aesthetically pleasing and can even hide other components of the solid fuel burning stove 20, as will be described in more details below.

Now referring to FIGS. 1 and 2, in the embodiment shown, the door panel 34 includes a door handle 44 mounted on a door handle bracket 42 so that the door handle 44 extends outwardly from the door panel 34, toward the exterior of the solid fuel burning stove 20. The door handle 44 can be made of heat resistant and insulating material, such as a thermoplastic, in order to protect the operator from the heat that can be conducted in the door handle bracket 42 during fuel burning inside the combustion chamber 27. The door handle 44 can be positioned on the door panel 34 at a location suitable for convenient opening and closing operation of the door panel 34. For instance, in the embodiment shown in FIGS. 1 and 2, the door handle 44 is located on a right end side of the door panel 34 when the door panel 34 is pivotally mounted to the housing 22 on a left end side of the door panel 34. This configuration allows the door panel 34 to open from right to left. Moreover, the door handle 44 can be mounted near a lower edge of the door panel 34 so that the door handle 44 can remain at a comfortable temperature for the operator during fuel combustion inside the combustion chamber 27. It is understood that other configurations and positioning of the door handle 44 are possible in other embodiments (not shown).

Figure 3:
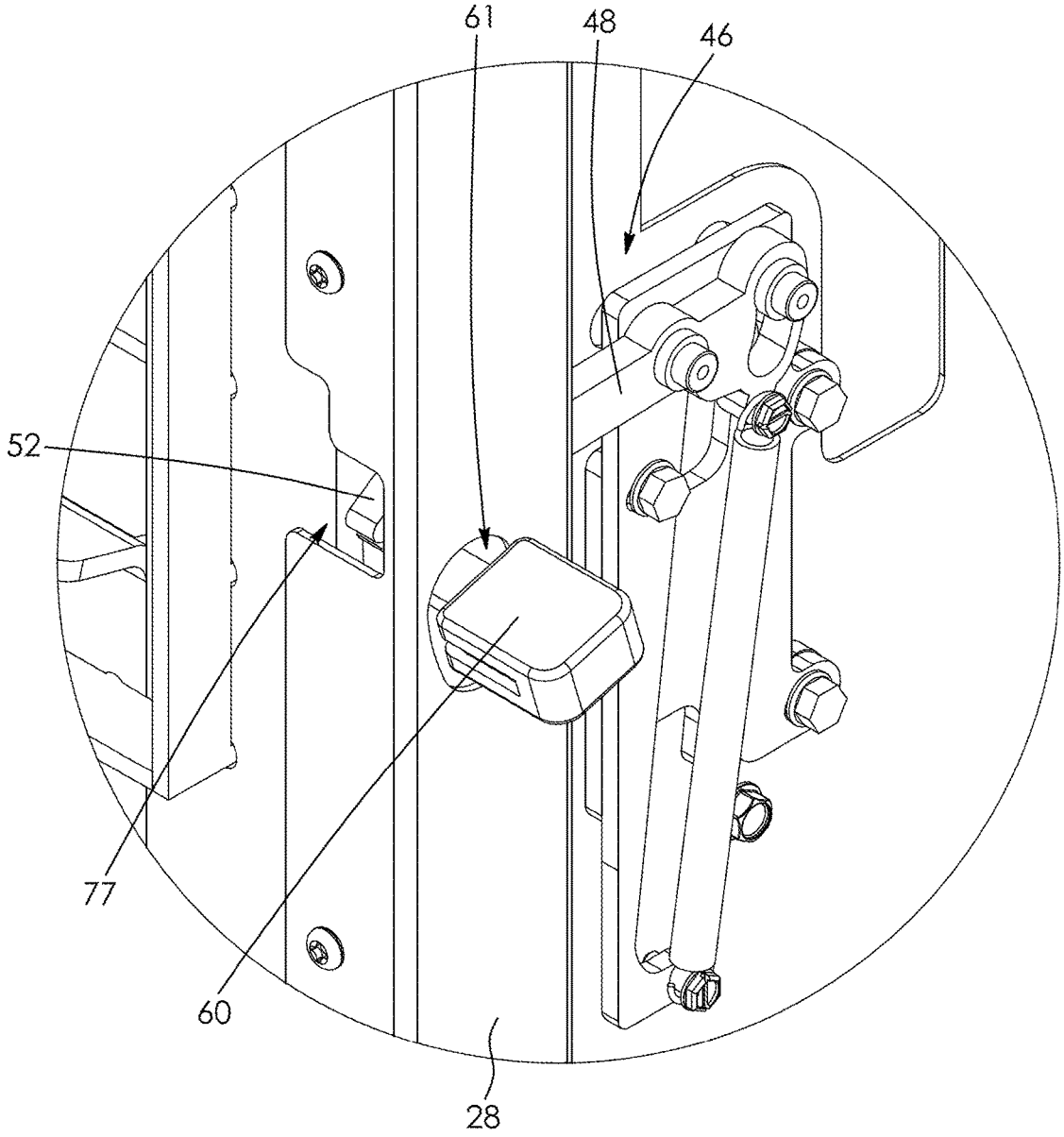
FIG. 3 is a front perspective view, enlarged, of a locking assembly of the solid fuel burning stove shown in FIG. 2, with the door panel in the open configuration.

Now referring to FIGS. 2 and 3, the solid fuel burning stove 20 further includes a locking assembly 46 for maintaining the door panel 34 in the closed configuration. The locking assembly 46 includes a lever 48 pivotally mounted to the housing 22 and a catch 76, engageable by the lever 48, mounted on the door panel 34. In the embodiment shown, the lever 48 extends substantially parallel to the side wall 26 of the housing 22. The locking assembly 46 further comprises a lever handle 60 mounted to the lever 48 and extending outwardly from the housing 22. The lever handle 60 can be manipulated to pivot the lever 48. More details about the lever 48 and the functioning of the locking assembly 46 will be described further below. Like the door handle 44 described above, the lever handle 60 can be made of heat resistant and insulating material, such as a thermoplastic, in order to protect the operator from the heat that can be conducted in the lever 48 during combustion. The outward extension of the lever handle 60 also provide sufficient clearance between the hand of the operator and the housing 22 which can become hot as combustion occurs in the combustion chamber 27, as shown in the embodiment of FIGS. 2 and 3.

Still referring to FIGS. 2 and 3, in the embodiment shown, one of the corner panels 28, adjacent to the locking assembly 46, includes a lever handle aperture 61 and a catch aperture 77, defined respectively in a side wall and a front wall of the corner panel 28. Thus, the corner panel 28 can hide a section of the lever 48, which is juxtaposed to the side wall 26 and extends behind the corner panel 28, while allowing the lever handle 60 to extend through the lever handle aperture 61 to be easily manipulated. In other words, a section of the lever 48 extends between the side wall 26 and the corner panel 28 with the lever handle 60 extending through the lever handle aperture 61. In an embodiment, the catch 76 can be inserted in the catch aperture 77 of the corner panel 28 when the door panel 34 is in the closed configuration. In sum, the corner panel 28 can be installed for cosmetic purposes and allow the functioning of the locking assembly 46. In an alternative embodiment (not shown), a section of the lever 48 can extend through the catch aperture 77.

Figure 5:
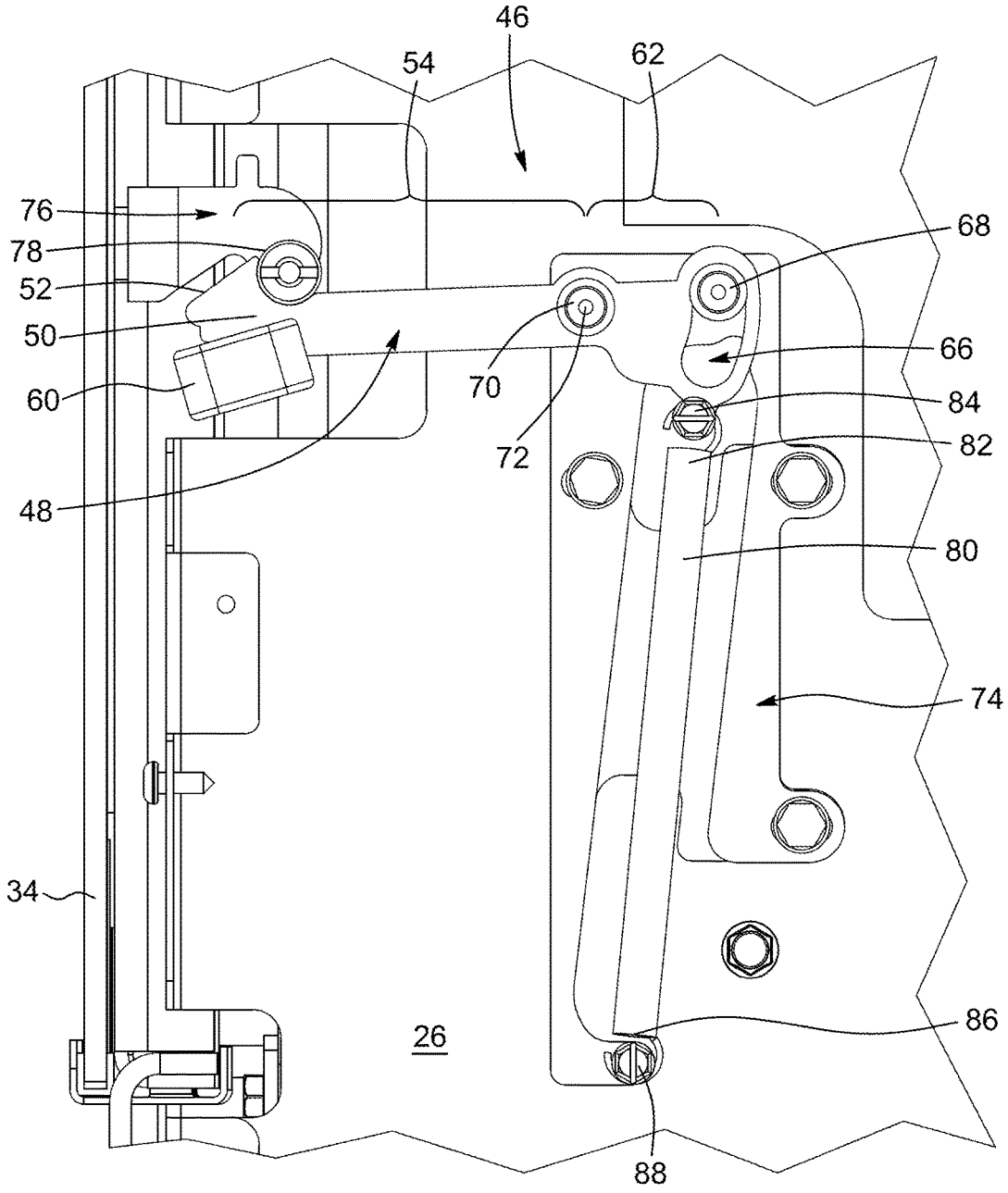
FIG. 5 is a right side elevation view of the locking assembly shown in FIG. 3, where the corner panel is removed.
Figure 6:
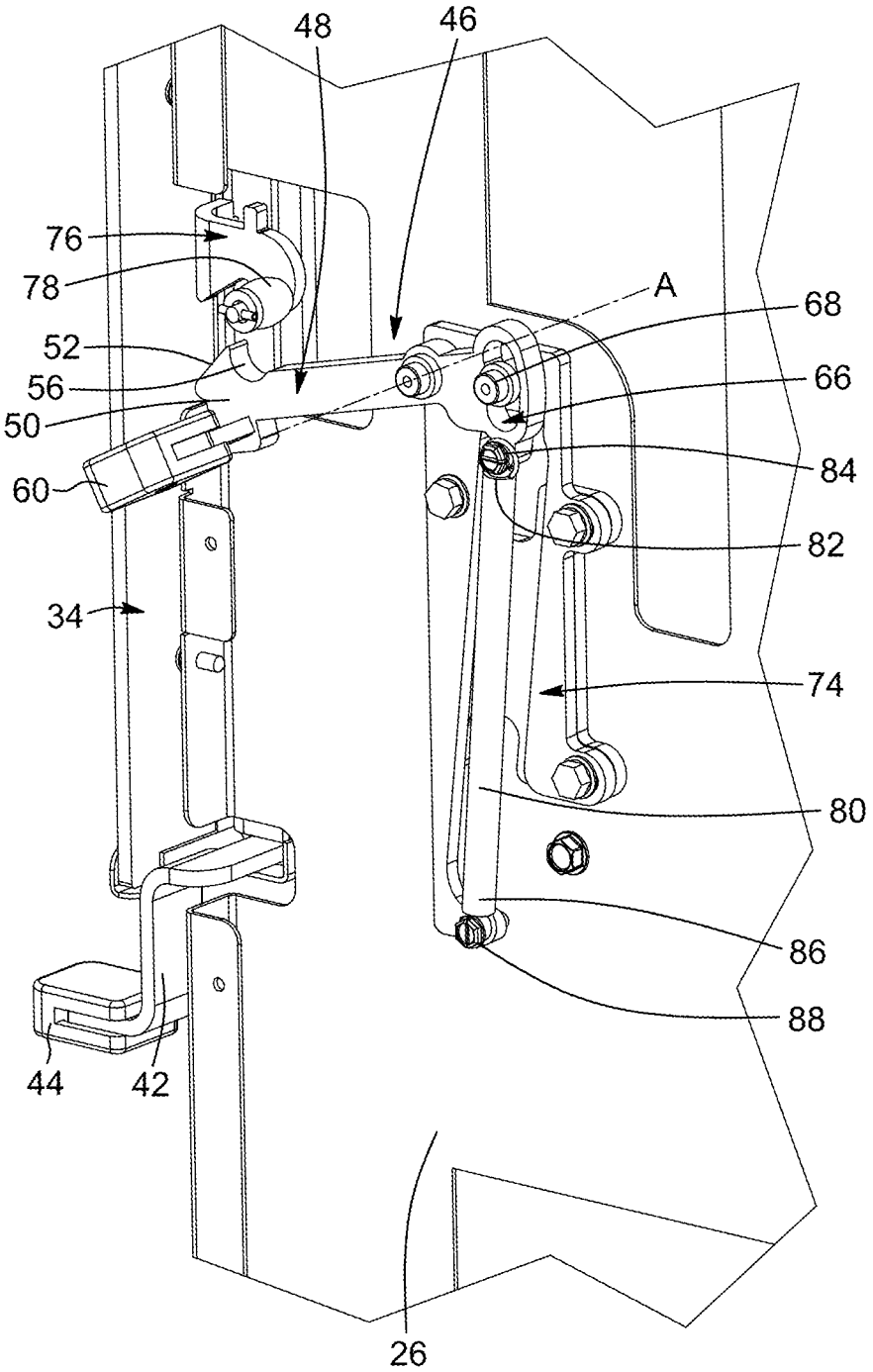
FIG. 6 is a rear perspective view of the locking assembly shown in FIG. 3 wherein the locking assembly is in the disengaged configuration, the door panel is in the closed configuration and the corner panel is removed.
Figure 7:
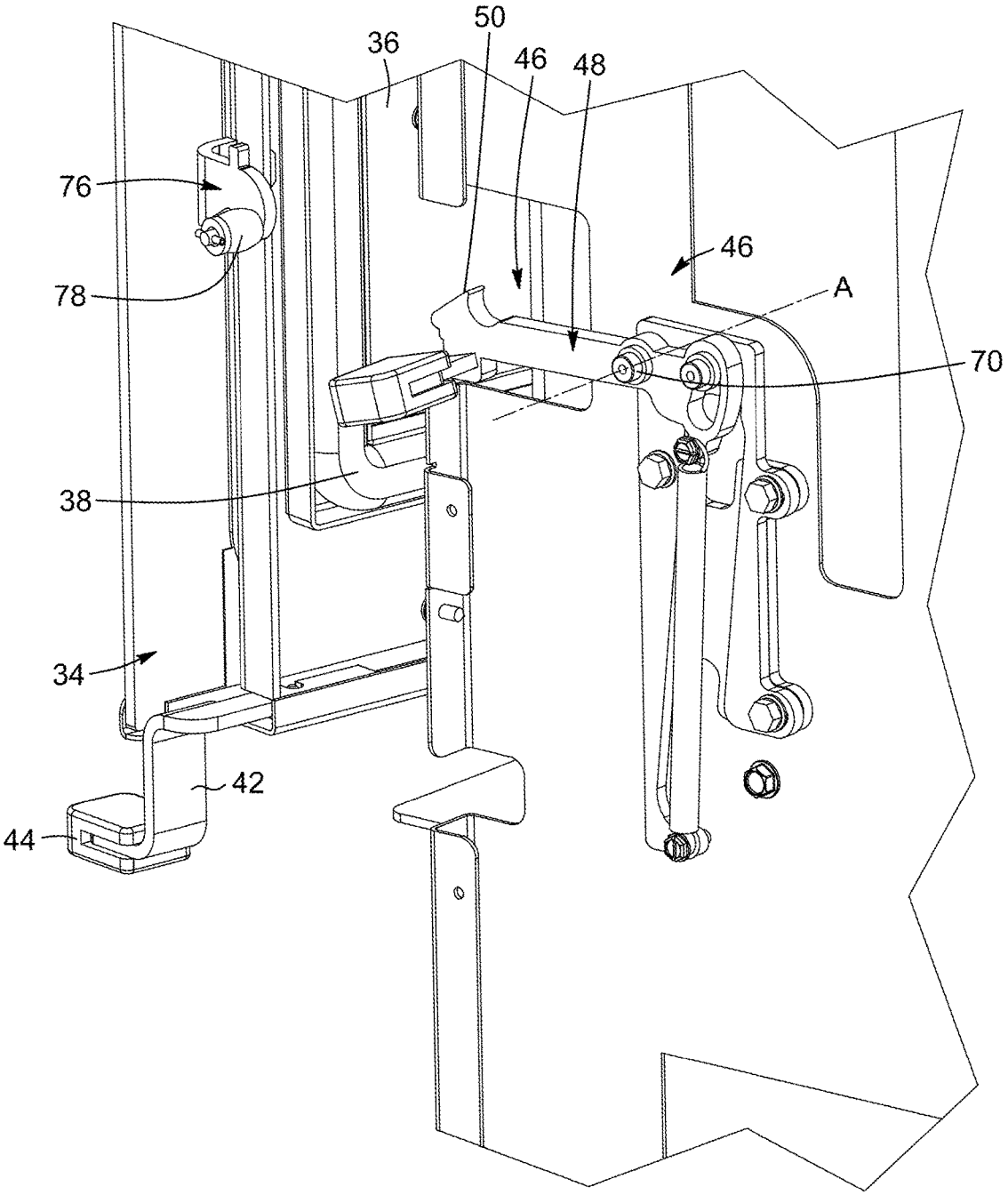
FIG. 7 is a rear perspective view of the locking assembly shown in FIG. 3, wherein the locking assembly is in the disengaged configuration, the door panel is in the open configuration and the corner panel is removed.

Now referring to FIGS. 1, 2 and 5 to 7, it is shown that the lever 48 has a hooked portion 50 at an end thereof. In the embodiment shown, the lever handle 60 is mounted to the lever 48, adjacent to the hooked portion 50, and extends outwardly therefrom. As will be described in more details below, the hooked portion 50 of the lever 48 is engageable with the catch 76. The lever 48 is pivotally mounted to the housing 22 through a pivot pin 70 (FIGS. 5 and 7). The lever 48 is pivotable between an engaged configuration (FIG. 5) wherein the hooked portion 50 is engageable with the catch 76 in the closed configuration of the door panel 34 and a disengaged configuration (FIG. 6) wherein the hooked portion 50 is disengaged from the catch 76.

The locking assembly 46 further includes a biasing member 80 operatively connected to the housing 22 and the lever 48. The biasing member 80 biases the lever 48 in the engaged configuration. In the embodiment shown in FIGS. 1, 2 and 5 to 7, the lever 48 and the biasing member 80 are mounted to one of the side walls 26. In the embodiment shown, the biasing member 80 of the locking assembly 46 is a tension spring but it is appreciated that it can be, for example, a bushing or any suitable device capable of creating a biasing force on the lever 48.

In the present specification, the terms "proximal" and "distal" are to be referenced to the lever 48. Hence, "proximal" is meant to characterize components that are located near the lever 48 and "distal" is meant to characterize components that are located further away from the lever 48. In the embodiment shown in FIGS. 1, 2 and 5 to 7, the biasing member 80 has a proximal end 82 operatively connected to the lever 48 by a proximal fastener 84 and a distal end 86 operatively connected and, more particularly secured, to the housing 22 by a distal fastener 88.

Referring to FIGS. 4 to 7, in the embodiment shown, the locking assembly 46 includes a frame 74 connected to the housing 22 on which some of the components of the locking assembly 46 are mounted. Notably, in the embodiment shown, the lever 48 and the biasing member 80 are mounted to the frame 74. The frame 74 can allow, for example, pre-assembling of some of the components of the locking assembly 46 prior to installation on the housing 22 as one assembly. In another embodiment (not shown), the locking assembly 46 does not include a frame 74 as the components of the locking assembly 46 can be mounted directly on the housing 22.

As mentioned above, the locking assembly 46 further includes the catch 76 provided on the door panel 34. The catch 76 is to be understood to be a component that holds immovably or that can be held immovably by another component, hence preventing movement for those components relative to each other. In an embodiment, the catch 76 includes a protruding bar extending substantially horizontally and outwardly from a free vertical edge of the door panel 34. The hooked portion 50 of the lever 48 is engageable with the catch 76 in the closed configuration of the door panel 34 and the engaged configuration of the lever 48. Moreover, the hooked portion 50 of the lever 48 is disengageable from the catch 76 by configuring the lever 48 in the disengaged configuration.

The lever 48 and the catch 76 can be made of any material suitable for resisting tensile stress and/or thermal stress such as cast iron, steel, aluminum, composite material, heat-resistant plastic material or a combination thereof.

In the embodiment shown in FIGS. 2 to 6, the catch 76 is mounted to a free end of the door panel 34. In some embodiments, the location of the catch 76 on the door panel 34 can vary from the embodiment shown and/or the arrangement and the configuration of the catch 76 can differ from the embodiment shown. For example, the catch 76 can be mounted to or defined in any point of the door panel 34 suitable for engagement and attachment with the hooked portion 50 of the lever 48.

Now referring to FIG. 5, the lever 48 will be described in greater details. In an embodiment, the lever 48 can be divided into an effort arm 54, a fulcrum 72 and a resistance arm 62. The effort arm 54 withstands the actuation force applied on the lever 48 by the operator, through the lever handle 60, to pivot the lever 48 from the engaged configuration to the disengaged configuration. Accordingly, in the shown embodiment, the actuation force is applied downwardly on the lever handle 60 by the operator. In the illustrated embodiment, the hooked portion 50 of the lever 48 is comprised in the effort arm 54 of the lever 48. In the embodiment shown, the fulcrum 72 is embodied by the pivot pin 70 mounted to the frame 74 connected to the housing 22, thus defining a pivot axis A around which the lever 48 can pivot between the engaged configuration and the disengaged configuration. The resistance arm 62 withstands the biasing force, opposed to the actuation force applied by the operator and generated by the biasing member 80. As for all levers, the positioning of the fulcrum 72 and the respective lengths of both effort and resistance arms 54, 62 have an effect on the lever efficiency. Thus, the positioning of the lever handle 60 on the effort arm 54, the fulcrum 72 and the proximal fastener 84 on the resistance arm 62, i.e. where the biasing force is applied, has an impact on the actuation force applied by the operator on the lever handle 60 so that the pivoting of the lever 48 about the pivot axis A generates an opposed biasing force that allows extension of the biasing member 80 operatively connected to the resistance arm 62. Thus, with a carefully selected positioning of the previously mentioned components, the operator can configure the lever 48 in the disengaged configuration with a light effort.

Now referring to FIGS. 5 and 6, the hooked portion 50 of the lever 48 will be described in details. In the embodiment shown, the hooked portion 50 of the lever 48 includes a notch 56 (FIG. 6). The notch 56 can be shaped and sized in relation to the shape and size of the catch 76 to which it is engageable. The notch 56 can operatively engage with the catch 76 and hold the catch 76 in place when the door panel 34 is in the closed configuration and when the lever 48 is in the engaged configuration.

Optionally, in an embodiment, the catch 76 can be made of or can include a magnetically-attractive element, thereby improving the coupling effect between the catch 76 and the hooked portion 50 of the lever 48. The magnetically-attractive element can be embodied by a permanent magnet, an electromagnet, a magnetically-susceptible material that is attracted to another magnet, or a combination thereof.

In the embodiment shown in FIGS. 5 and 6, the catch 76 includes a resilient sleeve 78 shaped and sized to operatively engage the notch 56 of the hooked portion 50 of the lever 48 when the door panel 34 is in the closed configuration and the lever 48 is in the engaged configuration. The resilient sleeve 78 can be made of, for example, a heat resistant elastomer so that the engagement between the hooked portion 50 of the lever 48 and the catch 76 is smooth and silent.

In the embodiment shown, the lever 48 comprises a beveled and rearwardly extending surface 52. The shape and size of the beveled and rearwardly extending surface 52 can be chosen in relation to the shape and size of the catch 76 to which it is engageable. The beveled and rearwardly extending surface 52 can act like the angled surface of a latch bolt. When the lever 48 is biased in the engaged configuration, as described above, and when the door panel 34 is pivoted from the open configuration to the closed configuration, the catch 76 abuts the beveled and rearwardly extending surface 52 and forces the lever 48 to pivot slightly toward the disengaged configuration. Once the door panel 34 is configured in the closed configuration, the lever 48 is automatically biased toward the engaged configuration as the catch 76 engages with the notch 56 so that the hooked portion 50 of the lever 48 holds the door panel 34 in the closed configuration. Thus, the beveled and rearwardly extending surface 52 can allow the locking assembly 46 to automatically maintain the door panel 34 in the closed configuration as the door panel 34 is pivoted from the open configuration to the closed configuration.

Furthermore, it is to be appreciated that the biasing member 80 can be configured or positioned on the housing 22 to bias the lever 48 upwardly or downwardly towards the catch 76. Thus, the orientation of the hooked portion 50 of the lever 48 may differ accordingly, i.e. the notch 56 of the hooked portion 50 of the lever 48 may be facing respectively upwardly or downwardly.

Now referring to FIGS. 1 and 5, in the illustrated embodiment, the catch 76 and the hooked portion 50 of the lever 48 are located behind the front face 35 of the door panel 34 when the door panel 34 is in the closed configuration. In other words, in the embodiment shown, the catch 76 and the hooked portion 50 of the lever 48 are hidden by the front face 35 of the door panel 34 when the door panel 34 is in the closed configuration. The positioning, shape and size of the catch 76, the hooked portion 50 of the lever 48 and the door panel 34 can lead to such a dissimulation which can be aesthetically pleasing. It is to be understood that other positioning, shape and size of the above-mentioned components can lead to a similar visual effect in other embodiments.

Now referring to FIGS. 5 and 6, in the embodiment shown, the locking assembly 46 includes a toe 68 protruding outwardly from the housing 22. The toe 68 is understood to be a component destined to stop the movement of an object. In the embodiment shown in FIGS. 5 and 6, the toe 68 is mounted to the frame 74, which in turn is connected to the side wall 26 of the housing 22. The toe 68 can be positioned to stop the pivoting of the lever 48 in the engaged configuration, the disengaged configuration or both. In another embodiment (not shown), the locking assembly 46 can include a plurality of toes positioned to stop the pivoting of the lever 48 in the engaged configuration, the disengaged configuration or both. In an alternative embodiment (not shown), the toe 68 can be mounted directly to the side wall 26 of the housing 22. Like the catch 76, the toe 68 can include a resilient sleeve made of, for example, a heat resistant elastomer so that the contact between the lever 48 and the toe 68 is smooth and silent.

Figure 4:
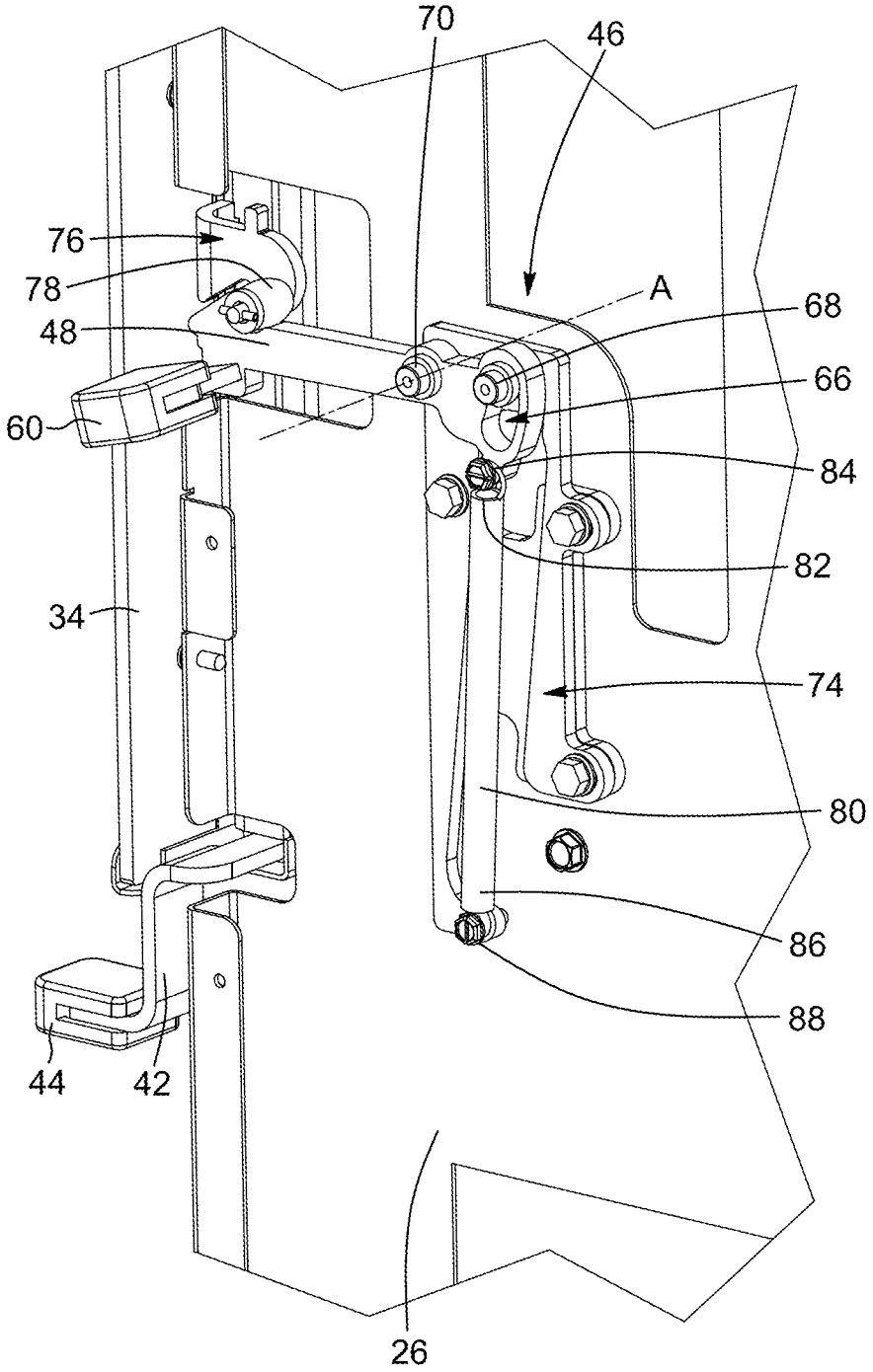
FIG. 4 is a rear perspective view of the locking assembly of the solid fuel burning stove shown in FIG. 3, in accordance with an embodiment wherein a corner panel of the solid fuel burning stove is removed.

Referring to FIGS. 4 to 6, in the embodiment shown, the lever 48 includes a guide track channel 66 located at an end of the lever 48 opposed to the hooked portion 50 and, more precisely, in the resistance arm 62 of the lever 48. The toe 68 extends within the guide track channel 66 of the lever 48. The guide track channel 66 is shaped and sized to receive the toe 68 and to allow the lever 48 to pivot between the engaged configuration and the disengaged configuration. Thus, the pivoting of the lever 48 is limited by the two configurations corresponding to the toe 68 abutting on the ends of the guide track channel 66: one corresponds to the engaged configuration and the other one corresponds to the disengaged configuration. The guide track channel 66 can also be shaped so that in the engaged configuration, the hooked portion 50 of the lever 48 is positioned to operatively engage with the catch 76, when the door panel 34 is in the closed configuration, or to be positioned to operatively engage the catch 76 with the help of the rearwardly beveled surface 52 when the door panel 34 is pivoted from the open configuration to the closed configuration. It is understood that other positioning of the guide track channel 66 and the toe 68 can lead to similar results. For example, the guide track channel 66 can be located in the resistance arm 54 of the lever 48 with the toe 68 mounted at an according position on the housing 22.

As illustrated in FIGS. 4 to 6, in the embodiment shown, the lever 48 pivots between the engaged configuration and the disengaged configuration about the pivot axis A that is located between the hooked portion 50 of the lever 48 and the guide track channel 66. In addition, in the embodiment shown, the distal end 86 of the biasing member 80 is operatively mounted to the housing 22 through the frame 74 and the distal fastener 88. In an alternative embodiment, the biasing member 80 can be mounted directly to the housing 22. The proximal end 82 of the biasing member 80 is operatively connected and, more particularly secured, to the lever 48, through the proximal fastener 84, rearwardly from the hooked portion 50 of the lever 48 and the pivot axis A, in the resistance arm 62. More particularly, in the embodiment shown, the proximal end 82 of the biasing member 80 is secured to the lever 48 below the guide track channel 66. Those optional configurations are exemplary only and it is understood that other configurations of the above-mentioned components are possible.

Now referring to FIG. 7, in the embodiment shown, the door panel 34 includes a seal member 38. The seal member 38 is mounted to the door panel 34 in a manner such that it surrounds an aperture 29 of the combustion chamber 27 in the closed configuration of the door panel 34. It is appreciated that, in an alternative embodiment (not shown), the seal member 38 can be mounted to the housing 22 and surround the aperture 29 of the combustion chamber 27. The seal member 38 is resiliently compressed between the housing 22 and the door panel 34 in the closed configuration of the door panel 34 and the engaged configuration of the lever 48 at an outline of the combustion chamber aperture 29. The seal member 38 can thus prevent heat losses through a gap formed between the housing 22 and the door panel 34 when the door panel 34 is in the closed configuration. The seal member 38 can be made of, for example, a resilient and heat resistant elastomer suited to resist the heat generated by the combustion of the fuel inside the combustion chamber 27 and resistant to wear due to the opening and closing of the door panel 34. Furthermore, the resilient compression of the seal member 38 creates a force on the door panel 34 opposing the pivoting of the door panel 34 into the closed configuration. This compression force on the seal member 38 is opposed by the catch 76 being immovably engaged with the hooked portion 50 of the lever 48, in the engaged configuration thus holding the door panel 34 in the closed configuration. When the lever 48 is configured in the disengaged configuration, there is no more opposition to the expansion efforts of the seal member 38. As the seal member 38 relaxes from its compressed state, the door panel 34 can be pushed away from the housing 22. The interaction between the relaxing and expanding seal member 38 and the housing 22, or the door panel 34, can lead to an autonomous opening of the door panel 34 from the closed configuration to the open configuration upon configuration of the lever 48 from the engaged configuration to the disengaged configuration thus releasing the catch 76 of the door panel 34 from the hooked portion 50 of the lever 48.

Several alternative embodiments and examples have been described and illustrated herein. The embodiments of the invention described above are intended to be exemplary only. A person of ordinary skill in the art would appreciate the features of the individual embodiments, and the possible combinations and variations of the components. A person of ordinary skill in the art would further appreciate that any of the embodiments could be provided in any combination with the other embodiments disclosed herein. It is understood that the invention may be embodied in other specific forms without departing from the central characteristics thereof. The present examples and embodiments, therefore, are to be considered in all respects as illustrative and not restrictive, and the invention is not to be limited to the details given herein. Accordingly, while the specific embodiments have been illustrated and described, numerous modifications come to mind. The scope of the invention is therefore intended to be limited solely by the scope of the appended claims.

The invention claimed is:

1. A solid fuel burning stove comprising:

a housing defining a combustion chamber;

a door panel pivotally mounted to the housing and being configurable between an open configuration allowing access to the combustion chamber and a closed configuration preventing access to the combustion chamber; and a locking assembly comprising:

a lever pivotally mounted to the housing and having a hooked portion, the lever being pivotable between an engaged configuration and a disengaged configuration and the lever comprising a lever handle extending outwardly from the housing;

a biasing member operatively connected to the housing and the lever and biasing the lever in the engaged configuration; and a catch provided on the door panel, the hooked portion of the lever being engageable with the catch in the closed configuration of the door panel and the engaged configuration of the lever and being disengageable therefrom by configuring the lever in the disengaged configuration, wherein the housing comprises a side wall partially defining the combustion chamber and a corner panel extending adjacent to the side wall and including a lever handle aperture and a catch aperture, wherein a section of the lever extends between the side wall and the corner panel with the lever handle extending through the lever handle aperture and the catch being inserted in the catch aperture in the closed configuration of the door panel.

2. The solid fuel burning stove as claimed in claim 1, wherein at least one of the catch and the hooked portion of the lever is located behind a front face of the door panel in the closed configuration thereof.

3. The solid fuel burning stove as claimed in claim 1, wherein the hooked portion of the lever comprises a beveled and rearwardly extending surface and a notch, extending rearwardly of the beveled and rearwardly extending surface, the beveled and rearwardly extending surface biasing the catch towards the notch of the hooked portion of the lever when configuring the door panel from the open configuration to the closed configuration.

4. The solid fuel burning stove as claimed in claim 1, wherein the locking assembly comprises a toe protruding outwardly from the housing and positioned to stop the pivoting of the lever in at least one of the engaged configuration and the disengaged configuration.

5. The solid fuel burning stove as claimed in claim 4, wherein the lever comprises a guide track channel and the toe extends within the guide track channel of the lever.

6. The solid fuel burning stove as claimed in claim 5, wherein the lever pivots between the engaged configuration and the disengaged configuration about a pivot axis located between the hooked portion of the lever and the guide track channel and wherein the biasing member has a distal end operatively connected to the housing and a proximal end operatively connected to the lever rearwardly from the hooked portion of the lever and the pivot axis.

7. The solid fuel burning stove as claimed in claim 1, wherein the catch comprises a resilient sleeve, the hooked portion of the lever being engaged therewith in the closed configuration of the door panel and the engaged configuration of the lever.

8. The solid fuel burning stove as claimed in claim 1, wherein at least one of the door panel and the housing comprises a seal member surrounding an aperture of the combustion chamber, the seal member being resiliently compressed between the housing and the door panel in the closed configuration and the engaged configuration of the lever and wherein the door panel pivots from the closed configuration to the open configuration upon configuration of the lever from the engaged configuration to the disengaged configuration by expansion of the seal member.

9. A solid fuel burning stove comprising:

a housing comprising a plurality of walls partially defining a combustion chamber, a lever pivotally mounted to at least one of the walls, and a biasing member having a proximal end operatively connected to the lever and a distal end mounted to at least one of the walls, the lever comprising a hooked portion and being pivotable about a pivot axis between an engaged configuration and a disengaged configuration and the biasing member biasing the lever towards the engaged configuration, wherein the lever and the biasing member are mounted to a side wall; and a door panel pivotally mounted to the housing and configurable between an open configuration and a closed configuration, the door panel comprising a catch, the hooked portion of the lever being engageable with the catch of the door panel in the closed configuration thereof and in the engaged configuration of the lever and being disengageable therefrom by configuring the lever in the disengaged configuration, wherein the lever comprises a lever handle extending outwardly from the housing and wherein the housing comprises a corner panel mounted adjacent to the side wall and including a lever handle aperture and a catch aperture, wherein a section of the lever extends between the side wall and the corner panel with the lever handle extending through said lever handle aperture and the catch being inserted in the catch aperture in the closed configuration of the door panel.

10. The solid fuel burning stove as claimed in claim 9, wherein at least one of the catch and the lever is located behind a front face of the door panel in the closed configuration thereof.

11. The solid fuel burning stove as claimed in claim 9, wherein the hooked portion of the lever comprises a beveled and rearwardly extending surface and a notch, extending rearwardly of the beveled and rearwardly extending surface, the beveled and rearwardly extending surface biasing the catch towards the notch of the hooked portion of the lever when configuring the door panel from the open configuration to the closed configuration.

12. The solid fuel burning stove as claimed in claim 9, wherein the housing comprises a toe protruding outwardly from the housing and positioned to stop the pivoting of the lever in at least one of the engaged configuration and the disengaged configuration.

13. The solid fuel burning stove as claimed in claim 12, wherein the lever comprises a guide track channel and the toe extends within the guide track channel of the lever.

14. The solid fuel burning stove as claimed in claim 9, wherein the proximal end of the biasing member is operatively connected to the lever rearwardly from the hooked portion of the lever and the pivot axis.

15. The solid fuel burning stove as claimed in claim 9, wherein the catch of the door panel comprises a resilient sleeve, the hooked portion of the lever being engaged therewith in the closed configuration of the door panel and the engaged configuration of the lever.

16. The solid fuel burning stove as claimed in claim 9, wherein at least one of the door panel and the housing comprises a seal member surrounding an aperture of the combustion chamber, the seal member being resiliently compressed between the housing and the door panel in the closed configuration and the engaged configuration of the lever and wherein the door panel pivots from the closed configuration to the open configuration upon configuration of the lever from the engaged configuration to the disengaged configuration by expansion of the seal member.

* * * * *